US006439271B2

(12) United States Patent
Schiller et al.

(10) Patent No.: US 6,439,271 B2
(45) Date of Patent: Aug. 27, 2002

(54) JET LOOM AND METHOD FOR ACHIEVING SUBSTANTIALLY IDENTICAL WEAVING CYCLE TIMES

(75) Inventors: Peter Schiller, Lindau; Dieter Teufel, Langenargen; Markus Gielen, Lindau, all of (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/875,783

(22) Filed: Jun. 6, 2001

(30) Foreign Application Priority Data

Jun. 6, 2000 (DE) ..... 100 28 049

(51) Int. Cl.[7] ..... D03D 47/28
(52) U.S. Cl. ..... 139/435.2; 251/129.04
(58) Field of Search ..... 139/435.2, 435.3; 251/129.04

(56) References Cited

U.S. PATENT DOCUMENTS 5,031,669 A * 7/1991 Wahhoud et al. ..... 139/435.2
5,295,515 A * 3/1994 Kato ..... 139/435.2

FOREIGN PATENT DOCUMENTS

DE 3043003 6/1981
DE 19547149 6/1997
DE 19723388 7/1998

* cited by examiner

*Primary Examiner*—Andy Falik
(74) *Attorney, Agent, or Firm*—W. F. Fasse; W. G. Fasse

(57) ABSTRACT

A valve arrangement of a loom includes valve modules held between flange plates and sharing a common inlet feeding into a common inner valve space. A valve outlet of each valve module leads to an insertion nozzle or nozzle group, and is controlled by a valve disk actuated by a piezoelectric actuator to rapidly dynamically adjust the pressure profile. A quality parameter, characteristic of the thread insertion flight time of each weft thread, is stored in a data bank and has a nominal pressure profile for achieving a nominal thread flight time allocated thereto. The actual thread flight time of each weft thread is measured and compared with the stored nominal thread flight time. A control signal responsive to the time difference is provided to the valve arrangement to control the piezoelectric actuator so as to adjust the pressure and/or the quantity of the pressure medium provided through the valve module to the connected insertion nozzle. Alternatively, the control signal is provided to the main loom rotational drive to adjust the rotational speed of the loom.

26 Claims, 2 Drawing Sheets

JET LOOM AND METHOD FOR ACHIEVING SUBSTANTIALLY IDENTICAL WEAVING CYCLE TIMES

PRIORITY CLAIM

This application is based on and claims the priority under 35 U.S.C. §119 of German Patent Application 100 28 049.8, filed on Jun. 6, 2000, the entire disclosure of which is incorporated herein by reference.

FIELD OF THE INVENTION

The invention relates to a method for controlling the weft insertion in a jet loom to achieve substantially identical weaving cycle times, and further relates to a jet loom for carrying out such a method.

BACKGROUND INFORMATION

German Patent 30 43 003 discloses a loom arrangement and a method for transporting the weft threads through the loom shed by means of a fluid jet. The basic object of the known method and apparatus is to operate the loom in an optimal manner by controlling the supply of high pressure fluid medium to the weft insertion nozzles during the weft insertion cycle, so that at every time point during the pick or weft insertion, just the right amount of high pressure fluid is provided to the insertion nozzles so that the desired weft insertion velocity or the desired weft insertion transit time is achieved in relation to the rotational speed of the loom. To achieve this, the known method provides for measuring the transport velocity of each inserted weft thread, then providing a signal representative of the measured transport velocity to a control system, which converts this signal to a control signal, which in turn influences or controls the pertinent components of the weft thread transport system for determining the travel velocity of the inserted weft thread.

More particularly, in a detailed embodiment of the known method and apparatus mentioned above, the time required for carrying out the weft transport, i.e. the weft flight time or weft transit time, is continuously measured, and then the average weft insertion time is determined over a plurality of successive picks or weft insertions. The determined average weft insertion time is compared to the desired weft insertion time, and then a signal representative of the determined time difference is provided to a control system in which this signal is converted into a control signal, which in turn influences the components of the weft thread transport system to adjust the weft insertion velocity for subsequent insertion cycles.

Thus, in order to form or obtain a control signal for influencing the components of the weft thread transport system, the known method calls for determining an average weft insertion time over a plurality of successive picks or weft insertions, with respect to each particular type of weft thread. Namely, each different weight, material, density, tightness, or surface characteristic of weft thread will generally have a different weft thread flight time or transit time for a given control condition of the weft insertion system. Thus, the average weft insertion time must be determined separately for each particular type of weft thread.

Then, the determined actual average weft insertion time is compared to the nominal weft insertion time for the respective associated weft thread type. That is a rather complicated and time consuming process and requires the loom operator to have at hand or to determine the necessary parameters of each type of weft thread that is to be processed by the loom.

The above mentioned German Patent 30 43 003 does not disclose any details regarding the type, arrangement and construction of the components of the weft thread transport system. Generally, however, it is known that weft thread transport systems in jet looms include insertion jet nozzles, a supply of pressurized fluid, and magnetic valves for switching, controlling or regulating the volume flows of the pressurized fluid to the respective nozzles.

In a different context, it is known to equip a valve with a piezoelectric drive or valve actuator, for example as disclosed in German Patent 197 23 388 or German Patent Laying-Open Publication 195 47 149. However, it is not known in the prior art to use such piezoelectrically actuated valves as components in a weft thread insertion system of a jet loom. Since the piezoelectrically actuated valves have different operating characteristics magnetically actuated valves, they would not be suggested as a simple replacement or exchange of the magnetic valves that are known in looms.

SUMMARY OF THE INVENTION

In view of the above, it is an object of the invention to provide a loom arrangement and a method for achieving substantially identical weaving cycle times while expressly avoiding the determination of an average weft insertion time per each respective weft thread type. It is a further object of the invention to provide a loom including a valve arrangement, as well as an operating method, which can compensate any time difference arising between the actual weft thread flight time and the nominal or rated weft thread flight time in a rapid reacting manner, substantially in real time on an on-going basis from cycle to cycle during operation of the loom. The invention further aims to avoid or overcome the disadvantages of the prior art, and to achieve additional advantages, as apparent from the present specification.

The above objects have been achieved according to the invention in a method of achieving substantially identical weaving cycle times and particularly weft insertion times for successive weft threads to be inserted into a loom shed of the loom by means of jet insertion nozzles, regardless whether the successive weft threads have identical thread quality parameters or respective differing thread quality parameters. The invention involves the following steps. Data representing at least one thread quality parameter of each weft thread that characterizes the weft thread flight time of this weft thread is stored in a data bank provided in the loom controller of the loom. A respective nominal or rated pressure profile or curve as a function of time that is intended to reliably ensure attainment of the desired nominal weft thread transit or flight time is allocated to the respective characteristic thread quality parameter. The actual thread flight time of each respective weft thread is measured and compared to the rated or nominal thread flight time. The just mentioned comparison results in a signal arising from the difference between the nominal thread flight time and the actual thread flight time, and this signal is delivered to the loom controller, in which the signal is converted into a control signal.

According to a first embodiment of the invention, this control signal is provided to a valve arrangement operatively connected to the weft thread insertion system, e.g. interposed between the pressurized fluid supply and the insertion nozzle or nozzles. Responsive to the control signal, this valve arrangement controls the pressure and/or the quantity of the pressurized fluid being provided to the insertion nozzles, in the sense of a continuous variation of the actual pressure profile of the pressurized fluid provided to the insertion nozzles. In effect, this is also a continuous adjustment of the nominal pressure profile. This can be carried out, for example, either by actually updating the previous stored nominal pressure profile data to a new revised nominal pressure profile to be used for subsequent weft insertions, or by superimposing the control signal over the previous or initial nominal pressure profile to provide a new revised nominal pressure profile signal based on a combination of the control signal and the previous or initial pressure profile.

According to a second embodiment of the inventive method, the control signal generated in the loom controller responsive to the difference between the nominal thread flight time and the actual thread flight time is used to control or adjust the rotational speed of the loom itself. Namely, in this embodiment, the signal resulting from the time difference between the actual thread flight time and the nominal thread flight time is used as a significant value for adapting the rotational speed of the main drive of the loom to the nominal thread flight time. In other words, rather than adjusting the pressure and/or the quantity of the pressurized fluid supplied to the weft insertion nozzles, the operating speed of the loom itself is adjusted.

The above objects have further been achieved in a jet loom with a particular inventive valve arrangement for carrying out the above described methods. According to the invention, the valve arrangement includes piezoelectric actuators for regulating or controlling the pressure and/or the quantity of the pressurized fluid being supplied to the weft insertion nozzles. Further, the valve arrangement comprises at least one frame-like valve module having a valve outlet, with a respective one of the piezoelectric actuators connected to a valve disk that acts on the valve outlet. The valve arrangement further comprises first and second head-side flange plates between which the valve module is (or valve modules are) received and secured. At least one of the flange plates has a valve inlet therein. The pressurized fluid thus enters the valve arrangement through the valve inlet in one of the flange plates, and then selectively passes through the valve arrangement to exit through the valve outlet, under the control of the valve disk being selectively moved by the piezoelectric actuator.

A plurality of these valve modules, each having the same construction, can be assembled together to form the overall modular valve arrangement, whereby each one of the modules includes its own separately controllable piezoelectric actuator. Each one of these piezoelectric actuators is, for example, embodied as a vibrating or oscillating element with one fixed end and one freely vibrating end, whereby the respective valve disk is mounted on the free end of the actuator and positioned opposite the valve outlet of the respective valve module. In this embodiment in which the overall valve structure includes plural individual valve modules, each one of the valve modules is respectively allocated to and connected to a single weft insertion nozzle or a group of weft insertion nozzles of the weft thread insertion system.

As described above, each valve module has its own respective valve outlet that is individually controllable as also described above. However, the overall valve structure including plural valve modules has at least one common valve inlet. This valve inlet is preferably provided in one of the head-side flange plates that terminates the overall valve arrangement, i.e. holds and seals the valve modules therebetween. In other words, a plurality of the frame-like valve modules can be stacked adjacent one another and then enclosed or sandwiched between the flange plates acting as end plates. Thereby, the inner valve space within each valve module adjoins and freely communicates with the inner space of all the other valve modules, which in common receive the incoming pressurized fluid through the at least one common valve inlet.

At least one sensor, which detects the static pressure prevailing within the overall valve structure, is arranged within at least one of the valve modules, i.e. within the common inner space of the overall valve structure. The detected pressure value is represented as a corresponding electrical signal which is transmitted in any signal transmission manner, e.g. via an electrical conductor, from the pressure sensor to the loom controller.

A further sensor can be integrated or arranged in the respective valve outlet of each valve module, to detect the dynamic pressure of the pressurized fluid (i.e. pressure medium) flowing from the respective valve outlet through a pressure line (e.g. a pressure hose, pipe, conduit, etc.) to a respective connected weft insertion nozzle or nozzle group. The detected pressure values are then transmitted in the form of electrical signals from this sensor to the loom controller. On the one hand, this sensor serves to monitor the dynamic pressure level in the respective associated weft insertion nozzle or nozzles. On the other hand, this sensor further provides feedback for compensating the difference resulting from the comparison between the nominal thread flight time and the actual thread flight time in the weft insertion, by correspondingly providing a changed pressure. Namely, by monitoring the dynamic pressure level, this sensor enables the loom controller to provide the appropriate control signals to vary or adjust the pressure or the through-flow quantity of the pressure medium through the respective valve module to the respective associated weft insertion nozzle or nozzles, so as to bring the actual weft flight time into conformance with the nominal weft flight time in a subsequent insertion cycle. This variation or adjustment corresponds to automatically establishing an altered new nominal pressure profile for the respective associated weft thread in a following weft insertion. Namely, once the best pressure profile for precisely achieving the desired nominal weft flight time has been attained, the dynamic pressure sensor provides a signal representing the actually measured pressure profile, which may then be used to establish an updated nominal pressure profile to be used for subsequent insertion cycles.

In a further detailed embodiment of the invention, each piezoelectric actuator can cooperate with a measuring system and/or a pre-tensioning or biasing arrangement, which respectively provides a prescribed default flow gap between the valve outlet and the valve disk, or to provide the complete closure of the valve outlet by means of the valve disk. In a first example, the pre-tensioning arrangement comprises a permanent magnet connected to the piezoelectric element, and cooperating with an electrical coil that can be energized by a d.c. current. In a second example, the pre-tensioning arrangement comprises a compression spring or a tension spring operatively connected to the piezoelectric element. In connection with any embodiment of the pre-tensioning arrangement, or even without such a pre-tensioning arrangement, the above mentioned measuring system can be any known path distance measuring system, position sensor, travel sensor, distance sensor, etc. for measuring the position of the piezoelectric actuator and particularly the valve disk relative to the valve opening.

The inventive method and apparatus achieve the advantage that a data bank already available in the loom controller of the jet loom can be utilized, with an expanded functionality, so that the characteristic quality parameter or parameters of a weft thread, which are stored in the existing data bank, are further associated with a nominal pressure profile for the weft insertion, which is defined by data that may also be stored in the data bank. The initial data for the nominal pressure profile is provided empirically or by prior testing results, whereby this initial nominal pressure profile is expected to achieve a desired nominal weft insertion thread flight time for a weft thread having the particular given associated thread quality parameter. The invention then further updates or overrides this initial nominal pressure profile with an altered new nominal pressure profile in the event the measured actual weft flight time diverges from the desired nominal weft flight time.

Through the inventive use of the above described valve structure, especially including fast-acting piezoelectric actuators, the nominal or rated pressure profiles can be continuously and automatically varied or newly established in such a manner so that an optimal nominal pressure profile is always given for the respective weft insertion. Particularly, by means of the automatic pressure regulation and adjustment, which is carried out continuously and automatically during a weft insertion process, any arising time differences between the nominal and actual values of the weft flight time, or especially time differences between successive weaving cycles, can be completely eliminated. Thereby, it is possible to achieve substantially identical weft insertion flight times and substantially identical weaving cycle times throughout a succession of weaving cycles, regardless of the thread type of the weft threads being inserted. A further advantage is that the pressure profiles can be automatically adapted to various rotational speeds of the loom, or viewed in the opposite manner, the rotational speeds of the main drive of the loom can be altered to be brought into correspondence with the nominal pressure profiles.

Using the new inventive valve structure, a more rapid reaction time is possible, in comparison to the previous conventional magnetic valves, and thereby the control dynamics during the weft insertion are improved. It becomes possible to automatically and adjust the pressure and/or supply volume of the pressure medium to the weft insertion nozzles in real time with very little delay. Thereby the weft acceleration, weft insertion speed, and the like can be very precisely and dynamically controlled. Moreover, in addition to the weft insertion itself through the main and relay nozzles, other auxiliary functions can also be controlled using the new valve structure, for example the flow of pressure medium can be controlled for achieving the threading-in of the weft thread into the main nozzle, as well as the pneumatic laying-in or tucking-in of the weft thread ends for forming a laid-in selvage. Additionally, the new valve structure can be located at any convenient position in or on the loom. That enables an optimum layout of the pressure hoses or the like.

At least for the main nozzle functions, the valve structure can be operated in a nearly wear-free manner, because a neutral or default non-zero valve opening can be prescribed for providing the required base weft thread holding air flow. Preferably, the valve structure is connected directly to, or arranged very close lo to the main nozzles or other pressure medium consumers, whereby a dead volume and associated dead time, which have previously been caused by the unavoidable pressure build-up time of the pressure medium in the pressure hoses, can be essentially avoided by the inventive arrangement. This in turn means that the invention achieves a direct delay-free (or at least a very short) reaction time and a high accuracy in achieving the control functions.

Since the overall valve arrangement is preferably only provided with a single common valve inlet, the operating reliability is improved and the maintenance requirements of the valve arrangement are simplified. Also, by appropriately dimensioning the valve modules, or even by adding so-called blind modules that do not provide an active valve outlet connection, the total internal volume of the overall valve structure can be increased to the required extent so that a separate reservoir tank for supplying air to the main nozzles can be omitted.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
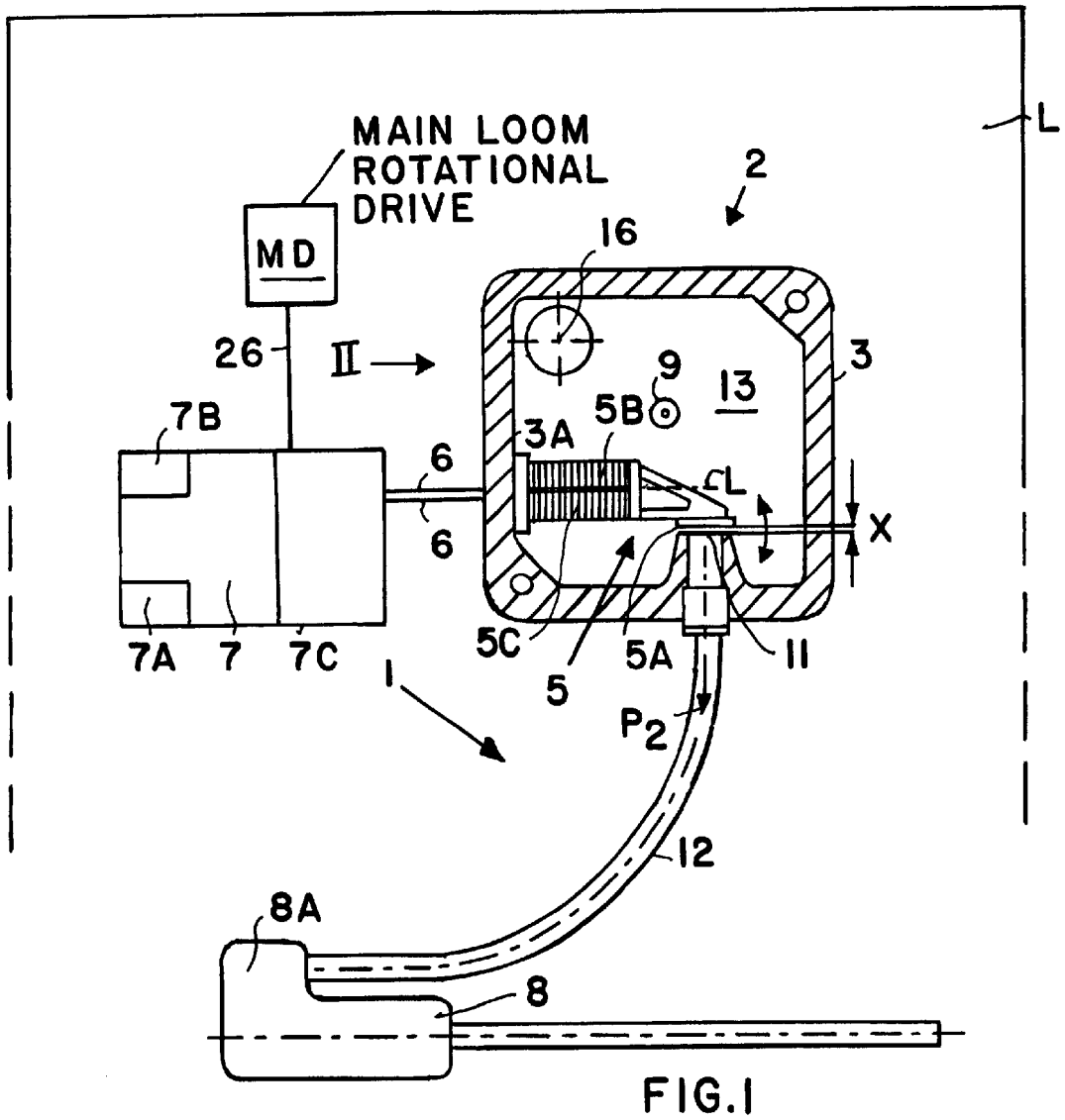
FIG. 1 is a schematic end view, partially in section, of a valve arrangement according to the invention, connected to the main weft insertion nozzle of a jet loom.

In the cross-sectional view of FIG. 1, it cannot be seen how many frame-shaped valve modules 3, 4 are included in the overall valve arrangement 2 of a weft thread insertion system 1 of a loom L.

As an example, it may be considered that the valve arrangement 2 of FIG. 1 includes only a single valve module 3. On the other hand, the valve arrangement 2 shown in FIG. 2 generally corresponds to the valve arrangement 2 shown in FIG. 1, as seen in the direction of arrow II, except that the valve arrangement of FIG. 2 includes two frame-shaped valve modules 3, 4. In any event, a respective piezoelectric actuator 5 is arranged in each one of the valve modules 3, 4. The piezoelectric actuator 5 is embodied as a piezoelectric oscillating or vibrating element having a fixed end rigidly mounted on the. inner wall 3A of the valve module 3, 4, and a free end that is generally free to oscillate or vibrate and protrudes from the inner wall 3A into the interior space of the respective valve module 3, 4. The piezoelectric actuator 5 generally is constructed as a piezoelectric element or stack of layers of piezoelectric material, in any generally known manner for piezoelectric actuators. Particular details thereof will be described further below.

A valve disk 5A is connected to the free end of the piezoelectric actuator 5, and is positioned to selectively open or close a valve outlet 11 passing through the wall of the respective valve module 3, 4. A controllable or variable valve gap X is formed between the valve disk 5A and the valve outlet 11, to control the flow of a pressurized fluid such as air or water therethrough.

The valve arrangement 2 further includes two head-side flange plates or end plates 13 and 14, with the valve module 3 or modules 3, 4 arranged and tightly sealed therebetween. Thus, an inner space is formed within the valve arrangement 2, bounded by the frame-like wall of the valve module 3 or modules 3, 4, and the flange plates 13 and 14. This arrangement and the flow of pressure medium therethrough will be described in further detail below in connection with FIG. 2.

For electrically actuating the piezoelectric actuators 5, each one of the actuators 5 is respectively individually connected via separate control lines 6 with the loom controller 7 of the loom, in a signal transmitting manner. The loom controller 7 includes a data bank 7A in which at least one thread parameter that is characteristic for the weft insertion is stored. Moreover, according to the inventive method, a nominal pressure profile for operating the weft insertion nozzles in such a manner to ensure the nominal weft flight time or weft insertion transit time is respectively allocated to each characteristic parameter of a weft thread in the data bank 7A. The loom controller 7 further includes a comparator 7B in which the actual thread flight time is compared with the nominal thread flight time.

The nominal or desired target flight time of the weft thread has been previously prescribed or determined and stored in the data bank 7A. On the other hand, the actual weft flight time is measured for each weft insertion using any conventionally known means, for example by respective weft sensors at the upstream and downstream sides of the loom shed, connected to a timing circuit to measure the time interval between the arrival of the thread at the upstream sensor and the arrival of the thread at the downstream sensor. The resulting actual thread flight time is provided as a corresponding signal to the loom controller 7 so that it can be compared to the nominal flight time in the comparator 7B as described above.

Then a signal at the output of the comparator 7B resulting from the difference between these two flight times is provided to the actual control unit 7C of the loom controller 7. In the control unit 7C, the received difference signal is converted into a control signal, which is then provided via the relevant control line 6 to the respective relevant piezoelectric actuator, which then responsively adjusts the valve gap X to influence or adjust the pressure and/or the flow quantity of the pressure medium being supplied through the valve outlet of the respective valve module 3, 4 to the associated weft thread insertion nozzle 8 through the connecting pressure line or hose 12. Thereby, the valve module 3, 4 carries out a continuous adjustment or variation of the actual pressure profile of the pressure medium being supplied to the respective weft insertion nozzle 8, which corresponds to a continuous adjustment or updating of the nominal pressure profile.

The basis for influencing or controlling the flow of pressure medium through the respective valve outlet 11 of the valve module 3, 4, is the rapidly reacting adjustment of the position of the valve disk 5A by means of the rapidly reacting actuation of the piezoelectric actuator 5, which may even be a rapid oscillating actuation, whereby the valve gap X between the valve disk 5A and the valve outlet 11 is correspondingly adjusted.

Figure 4:
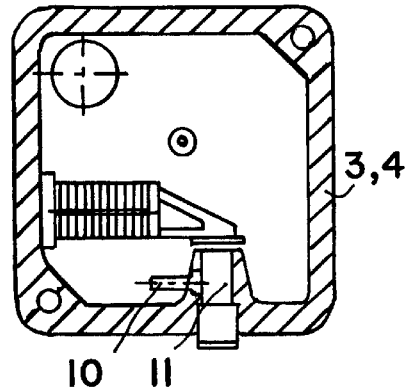
FIG. 4 is a schematic sectional view of a further valve module with a pressure sensor integrated into the valve outlet according to another embodiment detail of the invention.

In turn, feedback regarding the actual currently existing state of the piezoelectric actuator 5 and the connected valve disk 5A is provided by one or more sensors. For example, a sensor 9 arranged in the inner space of the valve arrangement 2 senses the static pressure that prevails within the valve arrangement 2. Alternatively or additionally, a further sensor can measure the currently existing actual size of the valve gap X, so that a defined valve gap X can be achieved, so as to provide a defined flow of the pressure medium from the respective associated valve module 3 to the respective weft thread insertion nozzle 8 connected thereto. Such an additional sensor for determining the valve gap X can be any conventionally known position sensor, distance sensor, travel sensor, or the like. Preferably, a second pressure sensor 10 is arranged in the flow path of the pressure medium between the valve gap X or the valve disk 5A and the weft thread insertion nozzle 8, for detecting the actual dynamic pressure P2 being provided through the pressure line 12 to the inlet 8A of the nozzle 8. A preferred arrangement in this regard is shown in FIG. 4, whereby the sensor 10 is incorporated directly into the valve outlet 11 of each respective valve module 3, 4. The several sensors are connected to the loom controller 7 by any conventional data lines, such as electrical conductors, which have been omitted from the drawings for the sake of simplicity and clarity.

The measured pressure profile provided by the second sensor 10 provides feedback regarding the actual pressure profile, and allows the loom controller 7 to establish a new updated nominal pressure profile for the weft insertions that follow a respective weft insertion in which there arose a difference between the actual and the nominal thread flight times or a difference between the actual and nominal pressure profiles. In other words, if the actual performance, as represented by the actual thread flight time or the actual pressure profile, did not correspond substantially exactly to the nominal thread flight time or the nominal pressure profile, then the pressure and/or the flow volume of the pressure mediu for the subsequent weft insertions will be adjusted and thus carried out in accordance with a new updated nominal pressure profile, as described above, to bring the actual performance. in. line with the nominal or desired target performance.

According to another embodiment of the invention, which is schematically indicated in FIG. 1 as well, the control signal may be provided to control or adjust the rotational speed of the main rotational drive MD of the loom, instead of or in addition to being provided to control the operation of the valve arrangement 2. Namely, the control signal may be derived in the same manner described above, responsive to the determined difference between the actual weft thread flight time and the nominal weft thread flight time. Then, by providing this control signal to the main loom rotational drive MD via a signal line 26, the rotational speed of the main drive can be adjusted for successive weft insertions in the event that the actual performance during any given weft insertion did not match the nominal or desired target performance. Thus, according to the invention, it is not only possible to dynamically adjust the flow of pressure medium provided to the weft insertion nozzles, but it is additionally or alternatively possible to dynamically adjust the rotational operating speed of the loom overall to bring the actual performance in line with the desired nominal performance.

In order to achieve a continuous dynamic variation and control of the actual pressure profile to match or update the nominal pressure profile, each piezoelectric actuator 5 is a bi-directionally effective actuator including an upper piezoelectric stack 5B and a lower piezoelectric stack 5C respectively extending parallel to each other above and below the lengthwise axis L of the actuator 5. The two piezoelectric stacks 5B and 5C are electrically connected to the control lines 6 with opposite polarity, i.e. the two piezoelectric stacks 5B and 5C are electrically driven in opposition or counter to each other. Thereby, the actuator 5 can be actively deflected along its axis L in a direction toward the valve outlet 11 and in the opposite direction away from the valve outlet 11, selectively in response to the actuating control signal. Thereby, the actual valve gap X between the valve outlet 11 and the valve disk 5A is correspondingly altered. Any other conventionally known embodiment of a piezoelectric actuator, or any conventionally known longitudinally effective actuator could alternatively be used as the actuator 5 in accordance with the invention.

Figure 2:
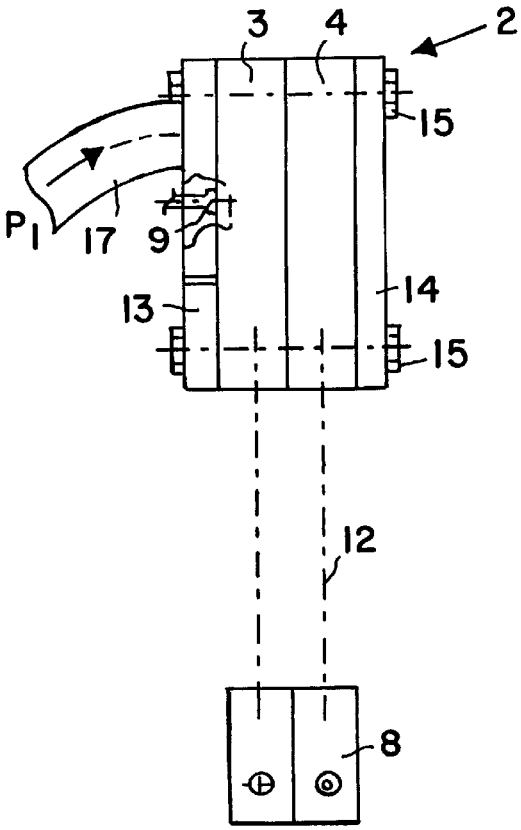
FIG. 2 is a schematic side view of the inventive valve arrangement and the main nozzle in the direction of arrow II in FIG. 1.

FIG. 2 shows an example of a valve arrangement 2 according to the invention, including a first valve module 3 and a second valve module 4, which are arranged, tightly held, and sealed between a first head-side end plate or flange plate 13 and a second head-side end plate or flange plate 14. Connectors 15 such as bolts, screws, clamps, or the like hold together the two flange plates 13 and 14 with the valve modules 3 and 4 therebetween. Any desired number of valve modules can be arranged between the flange plates 13 and 14, simply by providing connectors 15 of the appropriate length. Thereby, the modular construction of the valve arrangement 2 allows adaptation to the needs of any loom system, whereby the individual valve modules respectively control individual ones or groups of the main and relay nozzles.

The pressurized fluid is introduced into the inner space enclosed and bounded by the valve modules 3, 4 and the flange plates 13, 14, through a valve inlet 16 provided in the first flange plate 13, as shown in FIGS. 1 and 2. A pressure line or hose 17 connects a pressure source (not shown) to the valve inlet 16 of the valve arrangement 2, so as to supply the pressure medium at a basic static pressure P1 into the valve arrangement 2. On the other hand, the pressure lines or hoses 12 that connect the valve outlets 11 of the respective valve modules 3, 4 to the respective nozzles 8 are simply shown as dash-dotted lines in FIG. 2, and with solid lines in FIG. 1. It is also apparent that the pressure hose 12 respectively is connected to the inlet 8A of the respective nozzle 8. Further apparent in FIG. 2 is the arrangement of the pressure sensor 9 in the flange plate 13, for measuring the static pressure of the pressure medium prevailing in the inner space of the valve arrangement 2.

Figure 3:
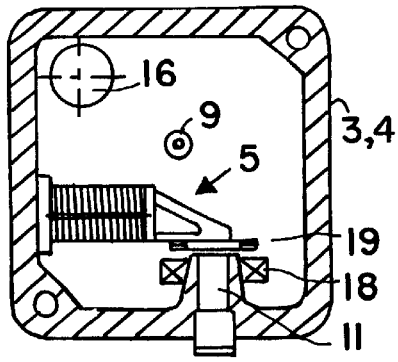
FIG. 3 is a schematic sectional view of a valve module with a pre-tensioning or biasing arrangement according to a further detailed embodiment of the invention.

FIG. 3 schematically shows an embodiment with a pre-stressing or biasing arrangement including an electrical coil 18 that is preferably electrically energizable with a d.c. current, arranged around the portion of the valve outlet 11 that protrudes inwardly into the inner space of the valve module 3, 4. Furthermore, the pre-stressing or biasing arrangement includes a permanent magnet 19 arranged on or around the valve disk 5A, to cooperate with the electrically energizable coil 18. This pre-stressing or biasing arrangement can have a loading or unloading effect on the piezoelectric actuator 5. Namely, by energizing the coil 18 to attract or repel the permanent magnet 19, the piezoelectric actuator 5. will be biased toward or away from the valve outlet 11, whereby the valve gap X between the valve disk 5A and the valve outlet 11 will be correspondingly made smaller or larger (or completely closed or opened). This can, for example, establish the neutral or non-energized position of the actuator 5. As an alternative embodiment, the biasing arrangement may comprise a compression spring or a tension spring (not shown) which is operatively connected to the actuator 5.

Figure 5:
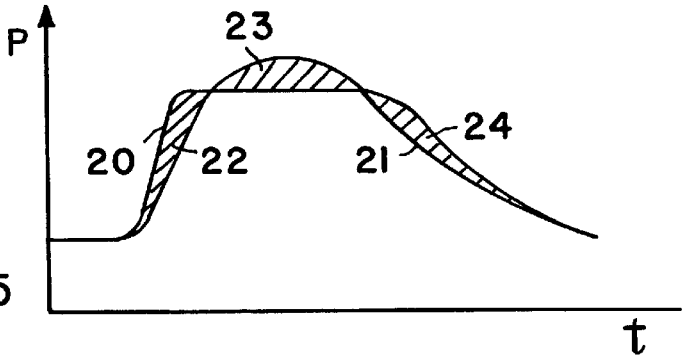
FIG. 5 is a graph schematically showing a nominal pressure profile of a two-way magnetic valve in comparison to a nominal pressure profile of an inventive valve module with a piezoelectric actuator in the weft insertion system of a jet loom.

FIG. 5 is a schematic diagram showing two different pressure profiles or curves 20 and 21 of the nominal pressure profile for the weft insertion nozzle 8 of a jet loom, over the course of time and particularly the weft thread flight time or transit time during the weft insertion. The first pressure curve 20 represents the pressure profile when using a conventional two-way magnetic valve, while the second pressure curve 21 represents a pressure profile that is dynamically controlled or influenced by a piezoelectric actuator 5 of a valve module 3 or 4 in the valve arrangement 2 according to the invention. By superimposing the two pressure profile curves 20 and 21 on each other, the differences between these two curves are represented by a first hatched area 22, a second hatched area 23, and a third hatched area 24.

Generally, it can be seen that the inventive pressure profile 21 is more smooth and sinusoidal in nature, while the pressure profile 20 achieved according to the prior art is more digital or linear in nature, with a characteristic achieved by the valve which is switched directly between minimum and a maximum open positions. Accordingly, the first hatch-lined region 22 demonstrates that the pressure profiled achieved according to the invention, in comparison to the pressure profile 20 achieved according to the prior art, achieves a more gentle and smoother initial acceleration of the weft thread. Namely, the valve arrangement 2 according to the invention, being activated by a piezoelectric actuator 5, avoids the more-abrupt off-on transition characteristic of the prior art magnetic valve resulting in the prior art pressure profile 20. On the other hand, the second hatch-lined region 23 shows that the pressure profile 21 according to the invention ultimately applies a higher weft-driving pressure and can therefore accelerate the weft thread being inserted to a higher insertion velocity. Then, the third hatch-lined region 24 shows that the fall-off of the pressure in the inventive pressure profile 21 is smoother and not as steep as the pressure fall-off at the tail end of the prior art pressure profile 20.

As an overall result, the inventive pressure profile 21, achieved with the inventive valve arrangement 2 and the inventive control method, provides a more uniform and gentle loading of the weft thread during the insertion phase. Namely, the weft thread is not subjected to abrupt or sudden changes in the driving jet pressure and is thus not forced to undergo as sudden an acceleration and deceleration. As a result, the tension loading on the weft thread is more uniform and more gradually changing. This achieves a better weft insertion result and avoids defects and weft faults. As a further overall result, the maximum pressure amplitude of the pressure profile can be increased, or generally varied as needed, to ensure the attainment of substantially as identical weft thread flight times for successive weft insertions, regardless of the thread type of the successively inserted weft threads. Also, by adjusting the pressure profile according to the invention "on the fly" or in real time during the insertion operation, any deviation of the actual performance from the nominal desired performance is quickly regulated-out, so that successive weft insertions are again brought into conformance with the desired nominal operation.

Throughout this specification, the terms "substantially identical" and the like do not require 100% equivalence or matching of the actual performance to the desired nominal performance. Instead, a standard acceptable deviation or tolerance, for example ±3% or ±5%, and particularly less than ±5%, is permitted between the actual performance and the nominal performance, while still being acceptable as "substantially identical". This is achieved by allowing a certain small maximum difference between the actual value and the stored nominal value, for example an acceptable time difference between the actual thread flight time and the stored nominal thread flight time, without triggering a correction or adjustment of the pressure profile. Only once the actual determined difference exceeds the acceptable difference limit will a corresponding adjustment of the pressure profile be carried out. This avoids a situation of repeatedly and constantly changing the pressure profile on each successive weft insertion, when the determined differences are only minimum differences within an acceptable tolerance or range of variation, for example resulting from slight variations of the thread quality and the like.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of operating a jet loom to achieve substantially identical weft thread flight times of successive weft threads being inserted into successive loom sheds in successive weaving cycles regardless of respective thread quality parameters of said successive weft threads, comprising the following steps:

a) prescribing a nominal weft thread flight time in which a weft thread is to be inserted into a loom shed during a weaving cycle;

b) prescribing an initial nominal pressure profile of a pressurized fluid to be supplied over time to a weft insertion nozzle during said weaving cycle for inserting said weft thread, wherein said initial nominal pressure profile is allocated to and based on is a thread quality parameter of said weft thread that is characteristically related to achieving said nominal weft thread flight time;

c) providing said pressurized fluid to said weft insertion nozzle through a piezoelectrically actuated valve arrangement according to said initial nominal pressure profile, so as to insert said weft thread;

d) measuring an actual weft thread flight time of said weft thread inserted during said step c) in a single present one of said weaving cycles that is being carried out;

e) comparing said actual weft thread flight time with said nominal weft thread flight time;

f) if said comparing in said step e) determines a substantial difference between said actual weft thread flight time and said nominal weft thread flight time, then generating a control signal responsive to and dependent on said difference;

g) performing one of the following sub-steps:

g1) sensing and measuring an actual pressure profile of said pressurized fluid provided through said valve arrangement to said weft insertion nozzle, and providing said control signal to said valve arrangement so as to actuate said valve arrangement so that said actual pressure profile deviates from said initial nominal pressure profile, for inserting a next successive weft thread in a next successive weaving cycle; or g2) providing said control signal to a main loom rotational drive so as to adjust a rotational speed of said main loom rotational drive; and h) repeating said steps d) to g) in successive weaving cycles so as to minimize said difference between said actual weft thread flight time and said nominal weft thread flight time.

2. The method according to claim 1, comprising carrying out said sub-step g1) in said step g).

3. The method according to claim 1, comprising carrying out said sub-step g2) in said step g).

4. The method according to claim 1, further comprising changing said nominal pressure profile that presently exists to an updated nominal pressure profile responsive to said control signal in each one of said successive weaving cycles in which said substantial difference is determined in said steps e) and f), and then controlling said valve arrangement according to said updated nominal pressure profile in a next successive one of said weaving cycles.

5. The method according to claim 1, further comprising expressly excluding determining an average weft thread flight time over plural successive ones of said weaving cycles.

6. In a jet loom including a pressurized fluid source, weft insertion nozzle, a valve arrangement interposed and connected between said pressurized fluid source and said nozzle to control a flow of a pressurized fluid from said source to said nozzle, and a loom controller connected to said valve arrangement to control said valve arrangement, an improvement in said valve arrangement comprising:

a valve body with a valve outlet connected to said nozzle, a piezoelectric actuator that is connected to said loom controller and that selectively varies a valve opening of said valve outlet to vary at least one of a pressure and a flow quantity of the pressurized fluid delivered through said valve outlet to said nozzle, and a first pressure sensor that is arranged in said valve outlet or in an interior space within said valve body and that is connected for signal transmission to said loom controller.

7. The improvement in the valve arrangement in the loom according to claim 6, wherein said valve body comprises a frame-shaped valve module including a frame-shaped valve module wall and said valve outlet through said valve module wall, said valve arrangement further comprises first and second flange plates arranged with said valve module therebetween, at least one of said flange plates has therein a valve inlet that is connected to said pressurized fluid source, and said piezoelectric actuator is arranged within said interior space which is bounded by said valve module wall and said first and second flange plates.

8. The improvement in the valve arrangement in the loom according to claim 7, wherein said valve arrangement comprises a plurality of said valve modules and a plurality of said piezoelectric actuators respectively connected to said valve modules and respectively cooperating with said valve outlets of said valve modules, and wherein said valve modules are all arranged successively adjacent one another between said first and second flange plates.

9. The improvement in the valve arrangement in the loom according to claim 8, wherein said interior space is a common continuous interior space among all of said valve modules, and said valve arrangement has only a single said valve inlet that supplies the pressurized fluid in common to the entirety of said common continuous interior space.

10. The improvement in the valve arrangement in the loom according to claim 8, wherein said interior space is a common continuous interior space among all of said valve modules, said first pressure sensor is an only single pressure sensor arranged in said common continuous interior space, and said valve arrangement includes no further pressure sensor in said interior space-in addition to said single pressure sensor.

11. The improvement in the valve arrangement in the loom according to claim 8, wherein each one of said piezoelectric actuators is respectively individually connected to said loom controller so as to be respectively independently controlled.

12. The improvement in the valve arrangement in the loom according to claim 6, wherein said piezoelectric actuator comprises a piezoelectric oscillating element having a fixed end rigidly connected to said valve body and a free end that protrudes into said interior space within said valve body and that is movable relative to said fixed end, and said valve arrangement further comprises a valve disk that is connected to said free end and that is located opposite said valve outlet and adapted to selectively vary said valve opening provided between said valve outlet and said valve disk as said valve disk moves together with said free end of said piezoelectric oscillating element.

13. The improvement in the valve arrangement in the loom according to claim 6, wherein said piezoelectric actuator comprises two stacks of piezoelectric layers, wherein said stacks are arranged parallel to each other along a lengthwise axis of said piezoelectric actuator, and wherein said stacks are electrically connected opposite each other so that said stacks are electrically energized in opposition to each other.

14. The improvement in the valve arrangement in the loom according to claim 6, wherein said first pressure sensor is arranged in said interior space.

15. The improvement in the valve arrangement in the loom according to claim 14, wherein said valve arrangement further comprises a second pressure sensor that is arranged in said valve outlet and that is connected for signal transmission to said loom controller.

16. The improvement in the valve arrangement in the loom according to claim 6, wherein said first pressure sensor is arranged in said valve outlet.

17. The improvement in the valve arrangement in the loom according to claim 6, wherein said valve arrangement further comprises a further sensor selected from the group consisting of a position sensor, a travel sensor and a distance sensor cooperating with said piezoelectric actuator to determine a currently existing state of said valve opening, and wherein said further sensor is connected for signal transmission to said loom controller.

18. The improvement in the valve arrangement in the loom according to claim 6, wherein said valve arrangement further comprises a biasing arrangement connected to said piezoelectric actuator so as to apply a biasing force onto said piezoelectric actuator.

19. The improvement in the valve arrangement in the loom according to claim 18, wherein said biasing arrangement comprises a permanent magnet connected to said piezoelectric actuator and an electrically energizable coil connected to said valve body adjacent to said valve outlet.

20. The improvement in the valve arrangement in the loom according to claim 18, wherein said biasing arrangement comprises a spring connected to said piezoelectric actuator.

21. The improvement in the valve arrangement in the loom according to claim 6, wherein said valve body and said valve outlet are connected directly to said nozzle without a pressure line interposed therebetween.

22. The improvement in the valve arrangement in the loom according to claim 6, wherein said loom controller comprises a control unit, a data bank, and a comparator.

23. The improvement in the valve arrangement in the loom according to claim 6, wherein said loom further comprises thread sensors and a timer arranged to measure an actual weft insertion thread flight time across a loom shed of said loom.

24. The improvement in the valve arrangement in the loom according to claim 23, wherein said first pressure sensor is arranged in said interior space.

25. In a jet loom including a pressurized fluid source, a weft insertion nozzle, a valve arrangement interposed and connected between said pressurized fluid source and said nozzle to control a flow of a pressurized fluid from said source to said nozzle, and a loom controller connected to said valve arrangement to control said valve arrangement, an improvement in said valve arrangement comprising:

a valve body with a valve outlet connected to said nozzle, a piezoelectric actuator that is connected to said loom controller and that selectively varies a valve opening of said valve outlet to vary at least one of a pressure and a flow quantity of the pressurized fluid delivered through said valve outlet to said nozzle, and a sensor selected from the group consisting of a position sensor, a travel sensor and a distance sensor cooperating with said piezoelectric actuator to determine a currently existing state of said valve opening, and wherein said sensor is connected for signal transmission to said loom controller.

26. In a jet loom including a pressurized fluid source, a weft insertion nozzle, a valve arrangement interposed and connected between said pressurized fluid source and said nozzle to control a flow of a pressurized fluid from said source to said nozzle, and a loom controller connected to said valve arrangement to control said valve arrangement, an improvement in said valve arrangement comprising a valve body with a valve outlet connected to said nozzle, and a piezoelectric actuator that is connected to said loom controller and that selectively varies a valve opening of said valve outlet to vary at least one of a pressure and a flow quantity of the pressurized fluid delivered through said valve outlet to said nozzle, and wherein said loom further comprises thread sensors and a timer arranged to measure an actual weft insertion thread flight time across a loom shed of said loom.

* * * * *

UNITED STATES PATENT AND TRADEMARK OFFICE

CERTIFICATE OF CORRECTION

PATENT NO. : 6,439,271 B2
DATED : August 27, 2002
INVENTOR(S) : Schiller et al.

It is certified that error appears in the above-identified patent and that said Letters Patent is hereby corrected as shown below:

Column 2,
Line 16, after "characteristics", insert -- than --.

Column 5,
Line 60, after "close", delete "lo".

Column 6,
Line 55, before "inner", delete ".".

Column 7,
Line 44, after "actuator", insert -- 5 --.

Column 8,
Line 37, before and after "in", delete ".".

Column 9,
Line 56, after "5", delete ".".

Column 10,
Line 48, after "substantially", delete "as".

Column 12,
Line 17, after "source,", insert -- a --.
Line 27, after "controller,", delete "and that selectively varies" and insert -- adapted to selectively vary --.

Signed and Sealed this

Twenty-first Day of January, 2003

JAMES E. ROGAN
*Director of the United States Patent and Trademark Office*